US005224434A

United States Patent [19]

Card et al.

[11] Patent Number: 5,224,434

[45] Date of Patent: Jul. 6, 1993

[54] METHOD AND APPARATUS FOR PRODUCING TUFTS FROM DIFFERENT YARNS IN LONGITUDINAL LINES

[76] Inventors: Roy T. Card, 4012 Creekwood Ter., Chattanooga, Tenn. 37421; Wilton Hall, 143 General Hays Rd., Fort Oglethorpe, Ga. 30742

[21] Appl. No.: 934,292

[22] Filed: Aug. 24, 1992

Related U.S. Application Data

[63] Continuation of Ser. No. 653,766, Feb. 11, 1991, abandoned.

[51] Int. Cl.[5] ..... D05C 15/30; D05C 15/22

[52] U.S. Cl. ..... 112/80.41; 112/80.52; 112/80.7; 112/266.2

[58] Field of Search ..... 112/80.41, 80.52, 80.55, 112/80.7, 80.5, 266.2

[56] References Cited

U.S. PATENT DOCUMENTS

| | | | |
|---|---|---|---|
| 3,903,625 | 2/1990 | Card et al. | 112/80.41 X |
| 4,119,049 | 10/1978 | Puckett | 112/266.2 |
| 4,226,196 | 10/1980 | Booth | 112/80.41 |
| 4,244,309 | 1/1981 | Spanel et al. | 112/80.4 |
| 4,366,761 | 1/1983 | Card | 112/80.41 |
| 4,836,118 | 6/1989 | Card et al. | 112/80.41 |
| 4,841,886 | 6/1989 | Watkins | 112/80.41 X |

FOREIGN PATENT DOCUMENTS

| | | | |
|---|---|---|---|
| 61-052894 | 3/1986 | Japan | 112/166 |

*Primary Examiner*—Clifford D. Crowder
*Assistant Examiner*—Paul C. Lewis
*Attorney, Agent, or Firm*—Hopkins & Thomas

[57] ABSTRACT

Front and rear needle bars are provided with front and rear needles for inserting yarns into a backing material. An excess of front loopers are provided for the front needles and an excess of rear loopers are provided for the rear needles. The front loopers respectively face the rear loopers and are respectively aligned with each other. The needle bars are shifted laterally so as to provide longitudinal rows of tufts formed by the front needles providing spacing between the tufts of a longitudinal row which space is filled in by the tufts of rear needles.

8 Claims, 3 Drawing Sheets

METHOD AND APPARATUS FOR PRODUCING TUFTS FROM DIFFERENT YARNS IN LONGITUDINAL LINES

This is a continuation of copending application Ser. No. 07/653,766 filed on Feb. 11, 1991, now abandoned.

BACKGROUND OF THE INVENTION

This relates to tufting machines and is more particularly concerned with an apparatus and method for producing tufts from different yarns in common longitudinal rows.

In the past, the tufting industry has long sought for an easy and efficient way of producing tufts from different yarn in selected single, longitudinal rows. Thus, stop needle machines were produced in which the needles of the tufting machine were aligned longitudinally but were selectively operated so that one needle sewed a portion of a longitudinal row while the other was stopped. Such machines were impractical for high speed tufting and were expensive to build, maintain and program.

Another form of prior art tufting machine which could produce tufts of different characteristics was the machine which had "cut-loop loopers." Such a machine had a cut pile looper with a spring clip which enabled the yarn feed mechanism to control, by the amount of yarn feed to the needle, whether the yarn formed a cut pile or a loop pile. The successive tufts in a longitudinal row, however, had to be from a single yarn and precluded multicolor tufts from different yarns in a single row.

Another form of providing a multicolored appearance in a tufted product was by producing high cut pile tufts in one row to overlie low loop pile in an adjacent row.

Still another method of tufting to produce a multicolored pattern involved the use of laterally shiftable front and back needle bars which enabled the needles of one needle bar to be moved so as to cooperate, selectively, with different laterally spaced loopers. All needles were inserted into the backing material for each reciprocation, however, the needles of one needle bar were always staggered with respect to the needles of the other needle bar and the front loopers were staggered with respect to the rear loopers. In such prior art machines, the shift of one needle bar with respect to the other, had to be a lateral distance equal to at least two gauges of tufting. U.S. Pat. No. 4,366,761 illustrates such a machine. The shifting by two gauges causes the accumulation of excessive yarns in the back stitches. By having to shift one needle bar two gauges with respect to the other, this prevented making a continuous diagonal row of tufts, using a selected yarn or yarns. Therefore, a diagonal line of tufting in a tufted product has had to appear as broken lines, formed by a succession of spaced discrete pin dots.

SUMMARY OF THE INVENTION

Briefly described, the present invention includes a tufting machine having pairs of longitudinally aligned loopers for cooperating with laterally shiftable needle bars. At times, the needles of one needle bar are longitudinally aligned with the needles of the second needle bar. Also at times, there are an excess of loopers for each row of needles, some or all of which are longitudinally aligned. The loopers can have a more narrow gauge than the needles so that longitudinal rows of the backing can be shared, thereby permitting a shift of a single gauge by either needle bar. This single gauge, lateral shifting enables the machine to produce a wide variety of fabrics which include diagonal rows formed of one or a plurality of yarns.

It is an object of the present invention to provide a tufting machine which can produce longitudinal rows of tufts, in which each longitudinal row can contain cut and uncut tufts of different yarns.

Another object of the present invention is to provide a tufting machine which can tuft different sizes or types of yarn as loop or cut pile in the same longitudinal row or rows.

Another object of the present invention is to provide a tufting machine which can provide one or more cut or looped tufts in adjacent rows.

Another object of the present invention is to provide a tufting machine which is capable of producing carpeting having a multitude of colors and textured patterns achieved through varying the threading and varying the shift sequence of the needle bars.

Another object of the present invention is to provide a tufting machine and a process of tufting which requires no buried or hidden short loops in order to produce patterned tufted fabrics which can contain cut tufts and looped tufts of uniform or different heights and different colored yarns.

Another object of the present invention is to provide a tufting machine and method of tufting in which the tufted fabric retains a full density of face yarn throughout the fabric.

Another object of the present invention is to provide a tufting machine and method of tufting which will minimize the amount of yarn in the back stitches, due to shifting of the needle bars.

Another object of the present invention is to provide a tufting machine and method of tufting in which the diagonals appearing in the pattern of the tufted fabric can be created by either a single or a plurality of yarn or yarns of a color different from the other yarns in the fabric.

Another object of the present invention is to provide a tufting machine and process of tufting which will produce longitudinal rows of cut pile with one, two, or three adjacent yarns and with loop pile yarns which have been shifted over the back stitch of the straight row or rows and vice-versa.

Another object of the present invention is to provide a tufting machine and method of tufting which can produce adjacent longitudinal rows of loop and cut pile without shifting of the fabric and which will retain the maximum density of the face yarn of the fabric.

Another object of the present invention is to provide a tufting machine and method of tufting which can obtain a tip sheared look (which, in the prior art, was achieved by shearing the high loops) without the extra step of tip shearing and without any appreciable loss of yarn.

Another object of the present invention is to provide a tufting machine and method of tufting which will produce a tufted fabric having a uniformly, random tip sheared look.

Another object of the present invention is to provide a tufting machine and method of tufting in which the needles can be shifted a single or a multiple of a single gauge, namely one, two, three or four gauges.

Another object of the present invention is to provide a tufting machine in which there can be longitudinal rows of loop pile and cut pile of different yarns and wherein the loop pile tufts are not thrust through the cut pile tufts.

Another object of the present invention is to provide a tufting machine and method of tufting in which the gauge integrity of the resulting fabric is maintained.

Another object of the present invention is to provide a tufting machine and method of tufting which will produce a tufted fabric having a woven Wilton appearance.

Another object of the present invention is to provide a tufting machine which can produce patterns and diagonals in a tufted fabric and still run at a standard tufting speed.

Another object of the present invention is to provide a tufting machine and method of tufting which will produce patterns and diagonals in the tufted product and can still run off of beams which save space in the plant and reduce waste (both in the tubes and on the cones of the creels) and are capable of making shorter rows, economically.

Another object of the present invention is to provide a tufting machine and method of tufting in which the pattern produced in the face yarns can be varied in color and texture or can be in texture only (cut pile and loop pile) or in color variations from cut pile with respect to loop pile.

Another object of the present invention is to provide a tufting machine and method of tufting which can be used for producing patterned goods from different sizes or types of yarns in the loop tufts and also in size and type in the cut pile, whereby various colors of yarns may be used or various twist levels of different types of yarns may be used.

Another object of the present invention is to provide a tufting machine in which different mixes of needles can be arranged on a plurality of needle bars, the needles being grouped for example in three adjacent needles on one bar for providing space capable of being filled in by the needles of the other needle bar.

Another object of the present invention is to provide a tufting machine and method of tufting which can make cut or uncut tufts in the central portion of the fabric or produce pin dots in the central portion and all loops or all cut tufts in the borders of the fabric.

Another object of the present invention is to provide a tufting machine and method of tufting in which the center portion of the tufted fabric can be all loop pile and the borders can be all cut pile or vice-versa.

Other objects, features, and advantages of the present invention will become apparent from the following description when taken in conjunction with the accompanying drawings wherein like characters of reference designate corresponding parts throughout the several views.

DETAILED DESCRIPTION

Figure 1:
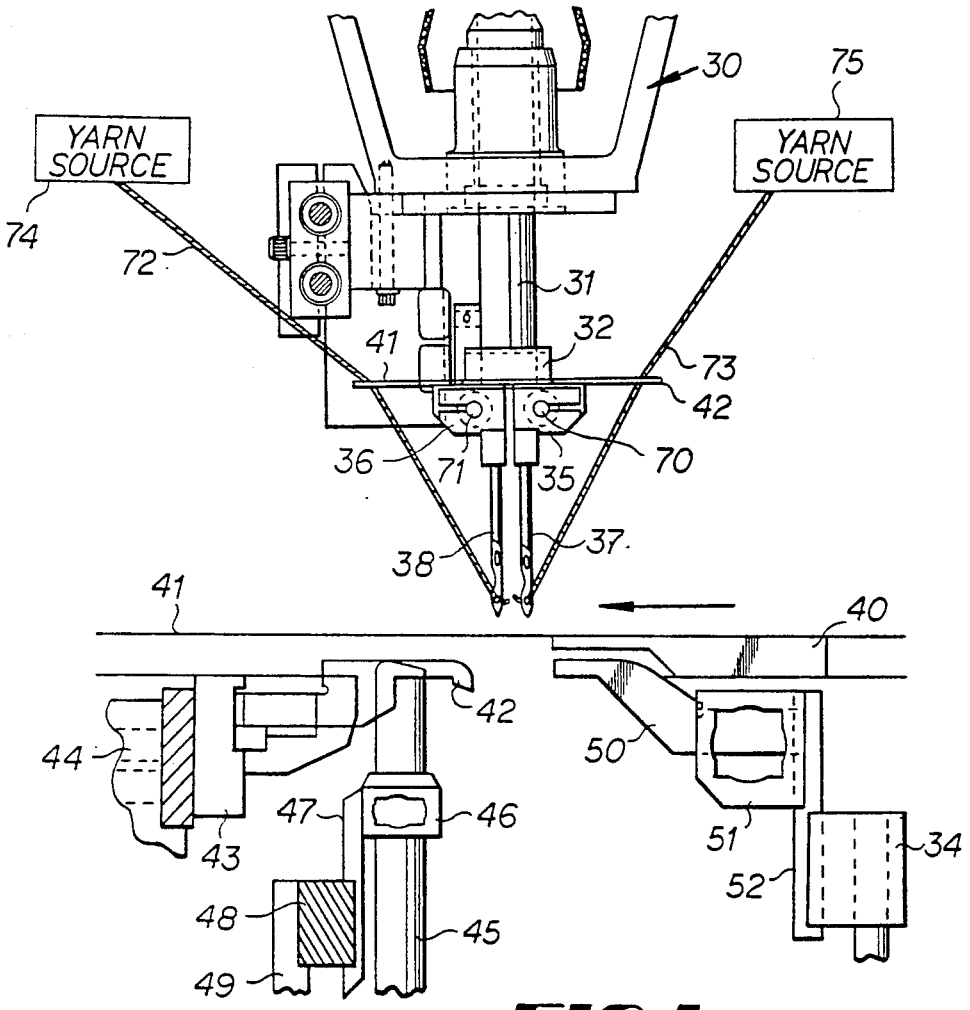
FIG. 1 is a fragmentary vertical sectional view of a tufting machine constructed in accordance with the present invention.

Referring now in detail to the embodiment chosen for the purpose of illustrating the present invention, numeral 30 in FIG. 1 indicates generally a conventional tufting machine which has push rods 31 which are reciprocated along their respective axes upwardly and downwardly, the push rods being provided at their lower end with a transversely extending needle bar support 32. The needle bar support 32 has, along its lower surface, a pair of transversely extending, laterally shiftable, parallel needle bars 35 and 36. The front needle bar 35 is provided with a row of transversely aligned, front needles 37 and the rear needle bar 36 is provided with a row of transversely aligned rear needles 38.

The tufting machine 30 also has a bed 40, over which the backing material 41 passes, the backing material 41 being disposed beneath the needles 37 and 38, so that the needles 37 and 38 simultaneously insert yarns 72 and 73 through the backing material, upon reciprocation of the needle bar support 32.

Below the backing material 41 the tufting machine 30 in FIG. 1 is provided with a plurality of cut pile loopers 42 the bills of which extend forwardly opposite to the direction of travel of the backing material 41 and cooperate with the rear needles 38 so as to catch and hold the loops of yarn sewn by these needles 38. These cut pile loopers 42 are carried by looper block 43 supported by a rocker assembly, denoted generally by the numeral 44. According to the present invention, the number of loopers 42 may and usually do exceed, substantially, the number of needles 38 and are of a more narrow gauge than the gauge spacing of needles 37.

Each looper 42 is provided with cut pile knife blade 45 carried by a block, such as block 46, the block 46 being supported at one end of a staff 47 which extends upwardly from the staff supporting bar 48 on a knife rocker assembly, denoted generally by numeral 49. The loops of yarn gathered by loopers, such as looper 42, are urged rearwardly of the machine 30 as they are carried by the backing material 41 and so that the loops are eventually pulled into the path of the knife blades, such as blade 45, and are severed or cut while they remain on the cut pile loopers 42. Thus all of the tufts accumulated on the cut pile loopers 42 will eventually be cut pile tufts.

Forwardly of the cut pile loopers 42 are the loop pile loopers, such as looper 50 in FIG. 1, each looper 50 being carried by a looper block 51 supported on a staff 52, from a loop pile rocker assembly, denoted generally by numeral 34.

Figure 2:
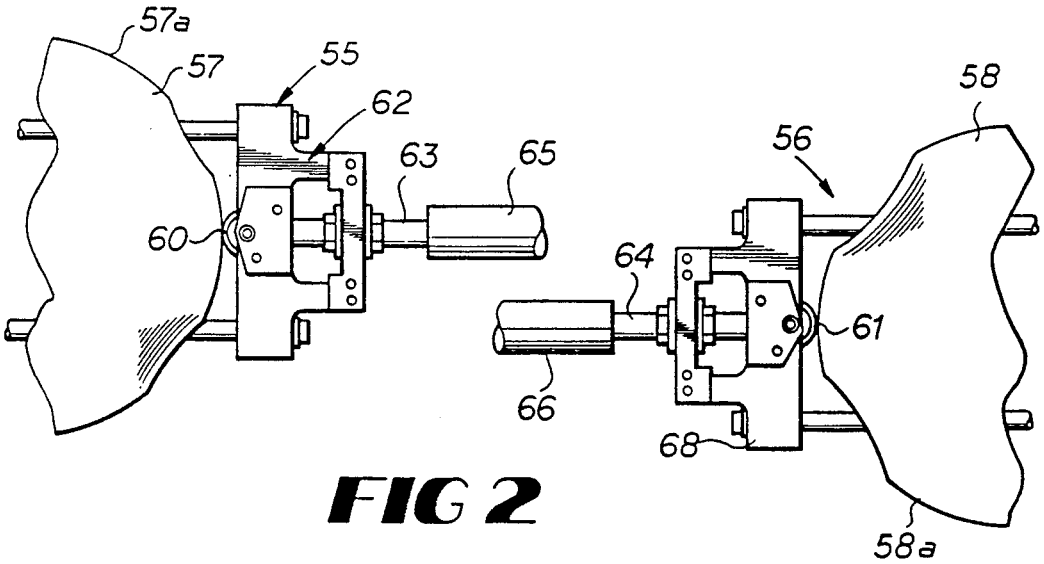
FIG. 2 is a fragmentary side elevational view showing the two needle bar control members which respectively control the lateral shifting of the needle bars of the tufting machine illustrated in FIG. 1.

In the present invention, the needle bars 35 and 36 are controlled by a pair of needle bar shift controls, denoted by the numerals 55 and 56 in FIG. 2. The needle bar shift control 55 includes a rotatable cam disc 57, rotatable about a fixed axis, the disc 57 being provided with a peripheral cam surface 57*a* having recesses and protrusions. A cam follower 60 rides along the peripheral cam surface 57*a* of the disc 57 and is carried by a shiftable frame 62. A second cam follower (not shown) is diametrically opposed to follower 60, also on frame 62. In like fashion, a second cam disc 58 has a peripheral cam surface 58*a* which engages cam followers, such as cam follower 61 to move a frame 68.

As seen in FIG. 2, the cam discs 57 and 58 are adapted to control, respectively, the lateral shifting of the needle bars 35 and 36, the peripheries of the disc forming camming surfaces 57*a* and 58*a*, respectively.

Cam followers, such as cam followers 60 and 61, on the respective shift frames 55 and 56, ride along the peripheries 57*a* and 58*a* of disc 57 and 58 so as to move the frames 62 and 68 laterally, as dictated by the peripheries 57*a* and 58*a*. The frames 62 and 68, in turn, are connected; via push rods 63 and 64, to links 65 and 66. Links 65 and 66, in turn, manipulate respectively the control rods 70 and 71, seen in FIG. 1, which protrude from the ends of needle bars 35 and 36.

Yarns 72 and 73 from yarn sources 74 and 75, such as creels or beams, are withdrawn at uniform rates and passed through yarn guides 41 and 42 to the needles 37 and 38, the yarns 72 being fed to the back or rear transverse row of needles 38 and the yarns 73 being fed to the front transverse row of needles 37. Patterned high-low loop tufts can be readily produced by substituting a conventional yarn control mechanism for the yarn source 75.

Figure 3:
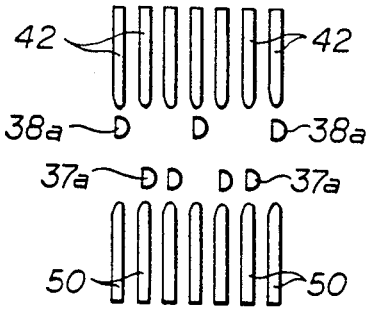
FIG. 3 is a schematic horizontal sectional view of the needles and the needle bars of the tufting machine shown in FIG. 1.
Figure 4:
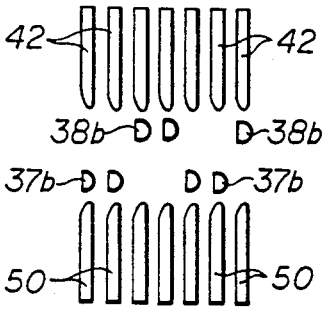
FIG. 4 is a view similar to FIG. 3 but showing a different spacing of the needles in the two needle bars.
Figure 5:
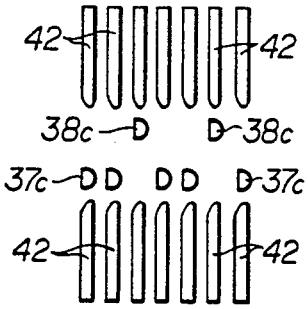
FIG. 5 is a view similar to FIGS. 3 and 4 and showing still another spacing of the needles of the two needle bars.
Figure 6:
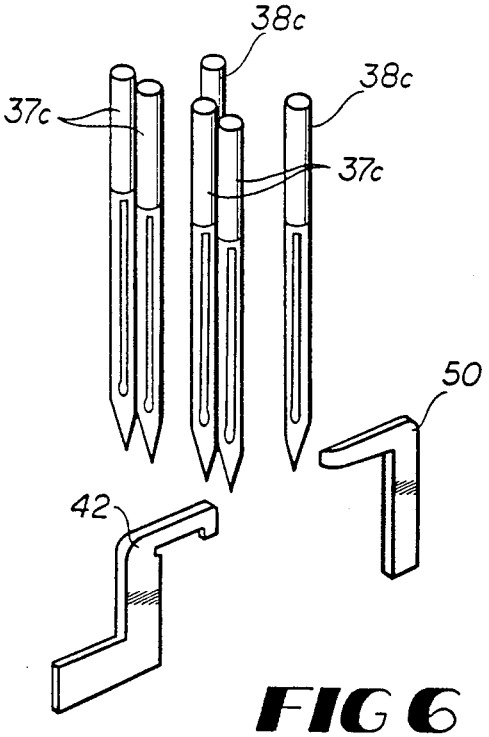
FIG. 6 is a fragmentary perspective view of some of the needles depicted in FIG. 5, associated with their loopers.

An important feature of the present invention is that the front loopers 50 are respectively aligned with the rear loopers 42. In FIG. 3, 4 and 5 are shown different arrangements of needles 37 and 38 with respect to the loopers 42 and 50, the needles which are substituted for front needles 37 being labeled needles 37*a*, 37*b*, 37*c* and the needles substituted for needles 38 being labeled 38*a*, 38*b*, and 38*c*.

In FIG. 3 needles 37*a* are spaced from each other by a spacing twice as wide as the spacing of their associated loopers 50 and the rear needles 38*a* are spaced from each other by a spacing which is twice the spacing of its associated loopers 42. Thus, through appropriate lateral shifting of one or both needle bars 35 and 36 for the needles 37*a* and 38*a*, by one, two or three loopers, left or right, only one needle 37*a* or needle 38*a* is sewing in a prescribed longitudinal row.

In FIG. 4, the front needles 37*b*, are arranged in spaced pairs along the transverse length of the tufting machine whereby the axes of the needles 37*b* of each pair are one gauge apart and the space between the axes of the adjacent needles 37*a* in adjacent pairs are spaced apart by a plurality (two) gauges.

The center lines of the adjacent front loop pile loopers 50 are all evenly transversely spaced apart by a single gauge while the center lines of the adjacent cut pile loopers 42 are evenly transversely spaced apart by a single gauge, the loop pile loopers 50 being respectively longitudinally aligned with each other.

The front loop pile loopers 50 are all in transverse alignment with each other and the cut pile loopers 42 are transversely aligned with each other. Furthermore, all of the cut pile loopers 42 rock forward as the loop pile loopers 50 rock forwardly and vice versa. The loopers 42 and 50 do not move laterally but simply rock toward and away from each other. Thus, when a needle 37*a*, 37*b* or 37*c* is appropriately positioned laterally, by one, two or three or more gauges, it is moved downwardly adjacent a prescribed looper 50 so that a loop of yarn 73 will be caught and momentarily held by the looper 50 and released after the needle 37*a*, 37*b* or 37*c* is retracted from backing 41.

In like fashion, the needles 38*a*, 38*b* or 38*c* are shifted laterally by one, two or three or more gauges and are moved downwardly, and their yarns are caught and cut by the cut pile looper assembly.

To synchronize the cams, the actions of the rear cam should be delayed from the action of the front cam, so that with a $\frac{3}{8}$" stagger for the needles and 8 stitches per inch, there should be a 3 stitch cam delay for the back cam with respect to the front cam; with 10.68 stitches/inch there should be a 4 stitch cam delay for the back cam with respect to the front cam; and with 13.33 stitches/inch there should be a 5 stitch cam delay between the front and back cam. With 16 stitches/inch a 6 stitch cam delay is required.

This is calculated in that a stagger of 0.375 inches or $\frac{3}{8}$ inches divided by cam delay in revolutions equals the length of each stitch. Thus, the longitudinal distance between the center lines of front and back rows of needles, divided by the cam delay in revolutions of the machine equals the longitudinal distance between adjacent stitches (length of each stitch).

In FIG. 3 it is seen that the rear needles 38*a* are spaced from each other so as to provide one needle for every third looper 42 and that each of the front needles are arranged in adjacent pairs, there being a space of one looper between each pair of adjacent needles. By such an arrangement, the fabric depicted in FIGS. 7 and 8 may be provided. Thus, without shifting the front needle bar, spaced rows of loop pile tufts 137*a* are sewn along spaced, parallel lines and the cut pile tufts 138*a* are produced by lateral shifting of the rear needle bar so as to produce in the backing material 41*a* a plurality of cut pile tufts in which the yarns 72 form the back stitches seen in FIG. 8 and the yarns 73 form the loop pile tufts 137*a*.

Figure 8:
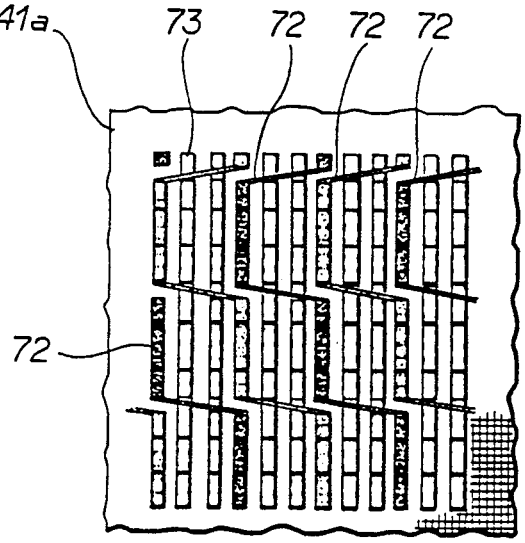
FIG. 8 is a fragmentary schematic bottom plan view of the fabric depicted in FIG. 7.

By laterally shifting the back needle bar only, the yarns 72, which are varied in color from the yarns 73 and can be varied in color from each other, produce a back stitch as indicated in FIG. 8 and the tufts indicated by numeral 138*a*, in the backing material 41*a*.

Figure 9:
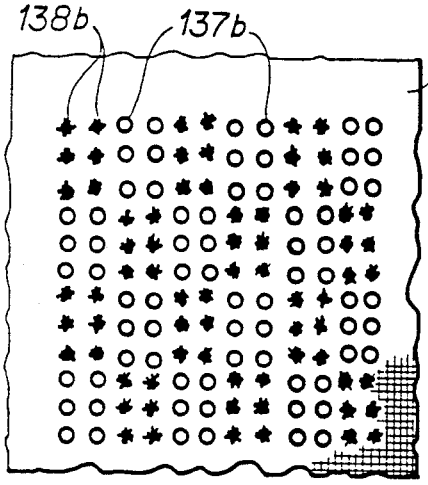
FIG. 9 is a fragmentary schematic plan view of the face yarns in fabric produced when the needles are arranged as shown in FIG. 4.
Figure 10:
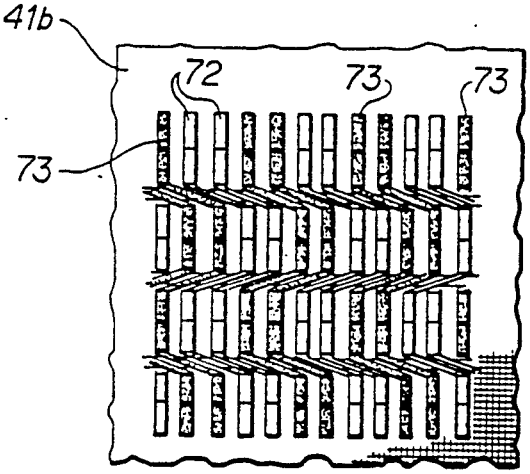
FIG. 10 is a fragmentary schematic bottom plan view of the fabric depicted in FIG. 9.

In FIGS. 9 and 10 is shown a tufting arrangement which is accomplished utilizing the needle spacing of FIG. 4. Here, by lateral shifting of both needle bars, the loop pile tufts 137*b* and the cut pile tufts 138*b* are produced in the backing material 41, the back stitching being formed by the yarns 72 and 73 as depicted in FIG. 10.

Figure 11:
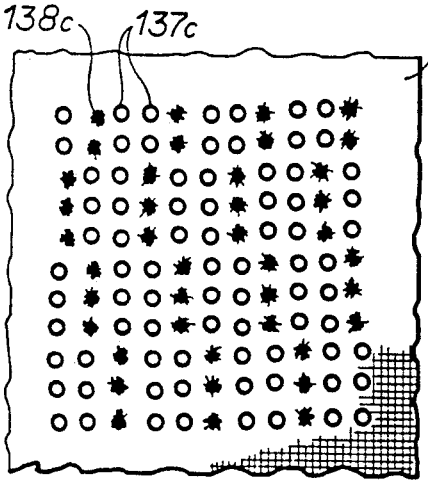
FIG. 11 is a fragmentary schematic plan view of the face yarns in fabric produced when the needles are arranged as shown in FIG. 5.
Figure 12:
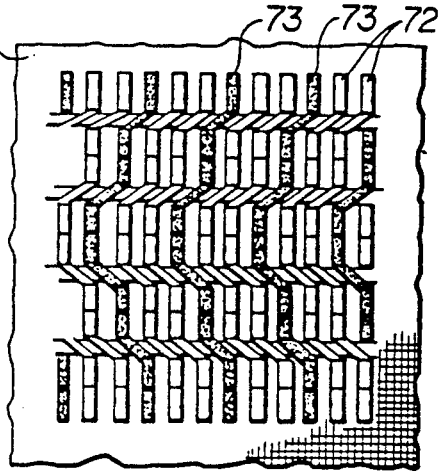
FIG. 12 is a fragmentary schematic bottom plan view of the fabric depicted in FIG. 11.

In FIGS. 11 and 12 are shown a pattern which can be produced utilizing the needle spacing depicted in FIG.

5. Here, the pairs of front needles 37*c* produce the tufts 137*c* as the back needles 38*c* produce the loop pile tufts 138*c*, the back stitching therefor being shown in FIG. 12. Here both needle bars are shifted and the yarns 72 produce the loop pile tufts 137*c* as the yarns 73 produce the cut pile tufts 138*c*.

Figure 7:
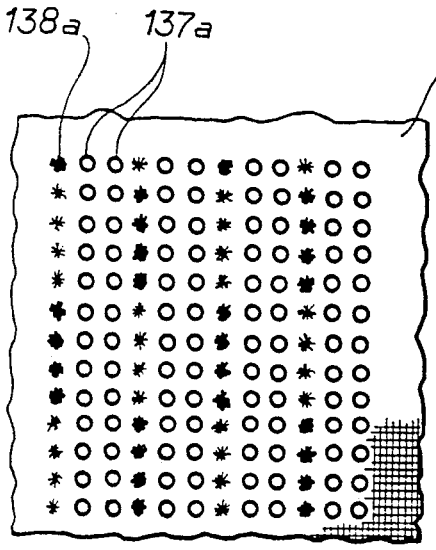
FIG. 7 is a fragmentary schematic plan view of the face yarns in fabric produced when the needles are arranged as shown in FIG. 3.

By providing a spacing of more than one looper between selected needles, and through appropriate shifting laterally of the needle bars, single longitudinal rows of tufts which selectively have both loop pile and cut pile are produced, as illustrated in FIGS. 7, 9, and 11.

It will be obvious to those skilled in the art that many variations may be made in the embodiment here chosen for the purpose of illustrating the present invention, without departing from the scope thereof as defined by the appended claims.

We claim:

1. A tufting machine having a frame through which a backing material is fed along a longitudinal path, a reciprocatable front needle bar disposed on one side of said backing material, transversely spaced front needles carried by said front needle bar for inserting first yarns carried by said front needles through said backing material for producing successive tufts of first yarns in said backing material upon reciprocation of said front needle bar, a reciprocatable rear needle bar disposed on said one side of said backing material, transversely spaced rear needles carried by said rear needle bar for inserting second yarns carried by said rear needles through said backing material for producing successive tufts of second yarns in said backing material upon reciprocating of said rear needle bar, means for reciprocating said front needle bar and said rear needle bar, a plurality of front loopers on the other side of said backing material for cooperating with said front needles, a plurality of rear loopers on the other side of said backing material for cooperating with said rear needles and control means for controlling the lateral shifting of said front needle bar and said rear needle bar, the improvement comprising said front loopers respectively being in longitudinal alignment, in the direction of feed, with said rear loopers, said front needles being of uniform gauge spacing and being provided with yarns in spaced groups such that the front needles sew yarns to produce selected longitudinal rows of tufts of first yarns, and said control means having means for shifting said front needle bar in gauge increments to sew yarns in other selected longitudinal rows and means for shifting said rear needle bar in increments so as to fill in tufts of said second yarns intermixing them with tufts of said first yarns in respective individual longitudinal rows for producing adjacent single parallel longitudinal rows of successive tufts in said backing material, each row containing tufts of first yarns and second yarns intermixed with each other.

2. The tufting machine defined in claim 1 wherein said front needles are fewer in number than said front loopers and said rear needles are fewer in number than said rear loopers.

3. The tufting machine defined in claim 1 wherein said rear loopers are cut pile loopers and said front loopers are loop pile loopers.

4. A tufting machine having a frame through which a backing material is fed along a longitudinal path, a reciprocatable front needle bar disposed on one side of said backing material, transversely spaced front needles carried by said front needle bar for inserting first yarns carried by said front needles through said backing material for producing successive tufts of first yarns in said backing material upon reciprocation of said front needle bar, a reciprocatable rear needle bar disposed on said one side of said backing material, transversely spaced rear needles carried by said rear needle bar for inserting second yarns carried by said rear needles through said backing material for producing successive tufts of second yarns in said backing material upon reciprocation of said rear needle bar, means for reciprocating said front needle bar and said rear needle bar, a plurality of front loopers for cooperating with said front needles, a plurality of rear loopers for cooperating with said rear needles and control means for controlling the lateral shifting of said front needle bar and said rear needle bar, the improvement comprising said front loopers respectively being in longitudinal alignment, in the direction of feed with said rear loopers, said front needles being provided with yarns in spaced groups such that the front needles sew yarns to produce selected longitudinal rows of tufts of first yarns, and said control means controlling the lateral shifting of said front needle bar in gauge increments to sew yarns in other selected longitudinal rows and laterally shifting said rear needle bar in increments so as to fill in tufts of said second yarns intermixed with tufts of said first yarns in respective individual longitudinal rows whereby a single longitudinal row of tufts in said backing material contains successive tufts of first yarns and second yarns sewn by the needles of the front row of needles and tufts sewn by needles of the back row of needles, said front needles being fewer in number than said front loopers and said rear needles being fewer in number than said rear loopers, said front needles being spaced apart by a distance equal to the spacing of said front loopers and a multiple of said spacing.

5. A tufting machine having a frame through which a backing material is fed along a longitudinal path, a reciprocatable front needle bar disposed on one side of said backing material, transversely spaced front needles carried by said front needle bar for inserting first yarns carried by said front needles through said backing material for producing successive tufts of first yarns in said backing material upon reciprocation of said front needle bar, a reciprocatable rear needle bar disposed on said one side of said backing material, transversely spaced rear needles carried by said rear needle bar for inserting second yarns carried by said rear needles through said backing material for producing successive tufts of second yarns in said backing material upon reciprocation of said rear needle bar, means for reciprocating said front needle bar and said rear needle bar, a plurality of front loopers for cooperating with said front needles, a plurality of rear loopers for cooperating with said rear needles and control means for controlling the lateral shifting of said front needle bar and said rear needle bar, the improvement comprising said front loopers respectively being in longitudinal alignment, in the direction of feed, with said rear loopers, said front needles being provided with yarns in spaced groups such that the front needles sew yarns to produce selected longitudinal rows of tufts of first yarns, and said control means controlling the lateral shifting of said front needle bar in gauge increments to sew yarns in other selected longitudinal rows and laterally shifting said rear needle bar in increments so as to fill in tufts of said second yarns intermixed with tufts of said first yarns in respective individual longitudinal rows whereby a single longitudinal row of tufts in said backing material contains successive tufts of first yarns and second yarns sewn by the needles of the front row of needles and tufts sewn by needles of said back row of needles, said front needles being fewer in number than said front loopers and said rear needles being fewer in number than said rear loopers, said rear needles being spaced apart by a distance equal to the spacing of said rear loopers and a multiple of said spacing.

6. A tufting machine having a frame through which a backing material is fed along a longitudinal path, a reciprocatable front needle bar disposed on one side of said backing material, transversely spaced front needles carried by said front needle bar for inserting first yarns carried by said front needles through said backing material for producing successive tufts of first yarns in said backing material upon reciprocation of said front needle bar, a reciprocatable rear needle bar disposed on said one side of said backing material, transversely spaced rear needles carried by said rear needle bar for inserting second yarns carried by said rear needles through said backing material for producing successive tufts of second yarns in said backing material upon reciprocation of said front needle bar, means for reciprocating said front needle bar and said rear needle bar, a plurality of front loopers for cooperating with said front needles, a plurality of rear loopers for cooperating with said rear needles and control means for controlling the lateral shifting of said front needle bar and said rear needle bar, the improvement comprising said rear loopers respectively being in longitudinal alignment, in the direction of feed, with said rear loopers, said front needles being provided with yarns in spaced groups such that the front needles sew yarns to produce selected longitudinal rows of tufts of first yarns, and said control means controlling the lateral shifting of said front needle bar in gauge increments to sew yarns in other selected longitudinal rows and laterally shifting said rear needle bar in increments so as to fill in tufts of said second yarns intermixed with tufts of said first yarns in respective individual longitudinal rows whereby a single longitudinal row of tufts in said backing material contains successive tufts of first yarns and second yarns sewn by the needles of the front row of needles and tufts sewn by needles of the rear row of needles, said needles of said front needle bar being arranged in spaced groups of adjacent needles and said needles of said rear needle bar being arranged in spaced groups of adjacent needles, the adjacent needles of each group of needles all being of a prescribed gauge, all loopers of said front loopers and all loopers of said rear loopers being spaced from adjacent loopers by said prescribed gauge whereby said control means controls the shifting of said front needle bar and said rear needle bar so as to provide evenly spaced successive tufts in each longitudinal row of tufts.

7. Method of tufting for producing tufts from different yarns in parallel longitudinal rows in a backing material comprising the steps of:

(a) feeding a backing material progressively along a longitudinal path of travel;

(b) disposing, in the direction of feed, longitudinally aligned transversely spaced pairs of loopers on one side of said backing material for forming a transverse row of rear loopers of a prescribed gauge with respect to each other and forming a transverse row of front loopers of the same prescribed gauge as the gauge of the front loopers;

(c) disposing a plurality of front needles in a transverse row of front needles adjacent to the other side of said backing material, said front needles being threaded with yarns so as to insert yarns carried thereby through said backing material to be caught by said front loopers;

(d) disposing a plurality of rear needles in a transverse row of rear needles adjacent to said other side of said backing material, said rear needles being threaded with yarns so as to insert yarns carried by said rear needles through said backing material to be caught by said rear loopers; and (e) laterally shifting said front row of needles and said back row of needles with respect to each other according to a prescribed pattern so as to sew transversely equally spaced, longitudinal rows of yarns in said backing material while reciprocating said front and rear needles so that the tufts sewn by said front needles and the tufts sewn by said rear needles are aligned in longitudinal rows and interspersed with each other in these respective longitudinal rows.

8. The method defined in claim 7 wherein the tufts sewn by the front row of needles, and the rear row of needles are essentially equally spaced from each other in said respective longitudinal rows.

* * * * *